US005472401A

United States Patent [19]

Rouillard et al.

[11] Patent Number: 5,472,401

[45] Date of Patent: Dec. 5, 1995

[54] RAMPED, HORIZONTAL, ON-BENCH ADJUSTABLE STRETCH BENCH FOR RELIEVING A USER'S BACK PAIN

[76] Inventors: Mark A. Rouillard, 388R Main St., Sanford, Me. 04073; Donald W. Hartford, 7 Ruth St., Sanford, Me. 04021

[21] Appl. No.: 226,635

[22] Filed: Apr. 12, 1994

Related U.S. Application Data

[63] Continuation-in-part of Ser. No. 2,415, Dec. 11, 1992.

[51] Int. Cl.[6] ..... A63B 26/00

[52] U.S. Cl. ..... 482/142; 482/907; 482/96; 606/241

[58] Field of Search ..... 482/142, 907, 482/96; 606/241, 242, 243, 244, 245; 601/24; 5/646, 647, 610, 612, 613, 617, 623; D21/191

[56] References Cited

U.S. PATENT DOCUMENTS 1,778,698 10/1930 Walter ..... 5/623
4,157,089 6/1979 Loughrey ..... 606/245
5,050,589 9/1991 Engle ..... 482/142
5,282,834 2/1994 Reny ..... 5/623

*Primary Examiner*—Lynne A. Reichard
*Attorney, Agent, or Firm*—Stan Jones

[57] ABSTRACT

A ramped and horizontal stretching bench for relieving spinal and muscle conditions contributing to back pain. More particularly a stretching bench that has moveable and adjustable settings for increasing the effectiveness of such relief. An arm brace and hand grip assembly is located under a horizontal bench portion that receives and supports a user's upper torso. The arm brace is readily adjustable as stretching exercises are on-going and without the user leaving the bench proper. Additional bench adjustments provide an individualized height setting, and these combined adjustments allow the bench to be personalized for each given individual in order to increase the effectiveness of certain on-the-bench stretching activities.

16 Claims, 6 Drawing Sheets

RAMPED, HORIZONTAL, ON-BENCH ADJUSTABLE STRETCH BENCH FOR RELIEVING A USER'S BACK PAIN

RELATED APPLICATIONS

This application is continuation-in-part of an earlier-filed application by the same inventors entitled, as amended, "Stretching Bench" on Dec. 12, 1992 and assigned Ser. No. 29/002,415.

BACKGROUND OF THE INVENTION

1. Field of the Invention

This invention relates to a ramped and horizontal stretching bench for relieving spinal and muscle conditions contributing to back pain, and more particularly to a stretching bench that has moveable and adjustable settings for increasing the effectiveness of such relief.

In our stretch bench technology, an arm brace and hand hold assembly is located adjacent the horizontal bench's forward portion where it is readily available for use as stretching exercises are on-going. In one embodiment of our invention, bench bench stretching activities.

2. Description of prior Art

A large percentage of people today experience back pain in spite of the exercise craze sweeping the country. It has been stated that eighty per cent of the working population experience back pain some time during their working careers. In particular, some back pain requires surgery that might have been avoided had a proper stretching bench and stretching routine been available.

Most exercise equipment is ill suited to the major task at hand, namely—stretching for relief of back pain. Indeed, some exercise benches available today tend to promote, rather than cure, back-pain related problems.

Back problems are a serious employment problem in the United States where back-pain-related costs are estimated to be in the range of fifty billion dollars per year. Surgery, when performed is often only partially successful and repeated operations are sometimes required with a low success rate being available.

A search of the prior art has revealed that therapeutic back rest devices are well known. One typical device is described in U.S. Pat. Nos. Des. 322,730 and 4,927,139 issued on May 22, 1990 to Taltre. The Taltre device is a semi-circular bridge shape without any adjustability features. Moreover, the shape of the semi-circular Taltre arc, some experts argue, is detrimental rather than curative.

Other classes of related art devices are described in the description of the Taltre patent. Most such art reveals that various configurations of adjustable body rest boards are well known. Typical of some adjustable configuration is the U.S. patent to Engle, U.S. Pat. No. 5,050,589 issued on Sep. 24, 1991. The Engle patent shows an inverted V shape with hinges and locking pins requiring off-the-bench adjustments. one portion of an inverted V-shaped bench.

Another patent to Kecala U.S. Pat. No. 4,546,967 has a long front seat portion and a short rear seat portion each of which are independently off-the-bench adjustable. In the Kecala patent, exercises are the predominant concern with stick figures being used to demonstrate many variations on muscle development. The Kecala exercises particularly involve a foot, ankle or thigh locking roll. The Kecala device is of chair seat height rather than waist high and is particularly complex in its various adjustment features.

Howze U.S. Pat. No. Des. 299,501 is a fixed rail bench of stepped configuration, and Johnson U.S. pat. No. Des. 277,21 9 is a low to the floor abdominal exercise bench with foot and ankle locking rolls. Cordon U.S. Pat. No. Des. 320,824 likewise discloses another variation on a foot and ankle locking roll in combination with a slanted seat.

A patent to Perrine, U.S. Pat. No. 3,817,243 discloses the use of a roller as a body massage device while the user does abdominal exercises. Hinged body rest boards are adjustable but do not provide any stretching capability as first disclosed and taught in this application.

Another body of prior art deals with various configurations of body mats that sometimes are shown piled into slanted or other body positioning configurations. Typical of such art are Prager U.S. Pat. No. 4,941,222 and Eary U.S. Pat. No. 4,901,384.

We have determined that none of the known prior art provides a body position device at waist height having a fixed ramp and horizontal body board combined together with a forward located arm brace and hand hold assembly for a series of stretching, self mobilization and/or traction movements. Additionally both on-bench and off-the-bench adjustability features are presented in this invention. The stretching bench invention allows the user to achieve isolation and relief of stress on a user's spinal discs, vertebrae and related back muscles.

SUMMARY OF THE INVENTION

A waist high padded stretching bench comprises a pair of floor supports for a single support rail which holds a padded body support board having two primary body support portions. One portion is a slanted knee and upper thigh rest body board extending upward from a rear support for about two and one-half feet at an incline angle of about forty-five degrees. At about waist height for a normal user, the support frame fixedly secures an upper body rest horizontal portion for supporting the prone upper torso of a user. These two supported body rest portions are fixedly secured to the support frame, and permit the user to fully stretch out and accomplish stretching, self mobilization and a series of low impact exercises.

The horizontal body rest portion fully supports the user's upper torso and the lower torso is likewise supported on the inclined padded body board section. The horizontal upper torso body section has a face relief opening located along the center line of the horizontal upper torso pad at the forward end thereof. At the fixed angle transition area of the stretching bench, the padded sections may be separated by a space or may comprise a single pad including a single pad with a reduced-size hour glass shape at the transition area.

The hour glass cutout allows the user after stretching, relaxing and allowing gravity to lengthen the vertebrae to rock back into a series of vertebrae alignment and stretching maneuvers to be described. The hourglass portion reduces and minimizes chafing of the user's arms while performing these maneuvers.

In accordance with this invention an arm brace and gripper bar is located at the forward portion of the stretch bench. Whether fixed or adjustable the brace/gripper assembly helps support the user in certain stretch moves, and also allows the user to rock back while the users knees are still on the incline pad and realign the vertebrae with a natural flowing movement. While lying prone on the stretching bench, the gripper bar may also serve as an arm brace. The brace/gripper assembly in certain embodiments of our invention is on-bench adjustable by the user.

An adjustable arm brace and hand grip assembly is positioned below the horizontal upper torso pad chassis with arm brace and hand grip extensions positioned transversely to the center line of the torso pad. The arm brace at its center section has a slidable collar which slides along a parallel cross support bar having a series of spaced openings located therein. This collar houses a spring loaded detent pin that drops into and is movable from one opening to the next along the underside of the horizontal support bar.

The arm brace extensions also serve as hand grips to be used for support during certain movements that the individual performs during stretching, self-manipulation and low impact exercises. On-the-bench adjustability allows the hand grip supports to be moved to optimum positions for vertebrae separation and alignment during such stretching movements. Off-the-bench height adjustments individually tailor the bench for the personal requirements of the user/owner.

BRIEF DESCRIPTION OF THE DRAWINGS

For a further understanding of the invention, reference can be had to the following detailed description taken in connection with the accompanying drawing, in which.

DESCRIPTION OF THE PREFERRED EMBODIMENT

Figure 1:
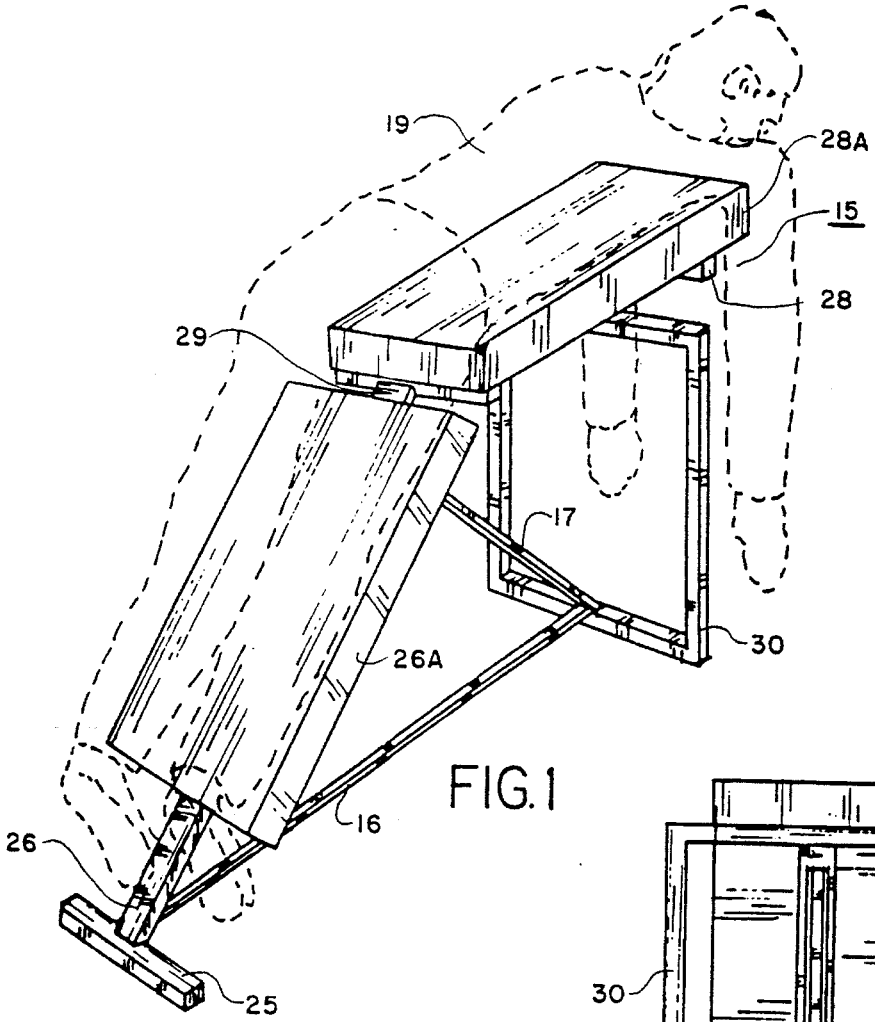
FIG. 1 is a top perspective view of a stretch bench embodying the features of our new design in which the human form shown in phantom is illustrative of the environment of our invention.

Referring now to the FIG. 15 represents a stretch bench of this invention and depicts a pair of floor supports 25 and 30 in FIGS. 1 through 4. Rear support 25 includes an inclined steel square tube 26, hereafter bar 26, welded or otherwise fixably attached to its center. Bar 26 extends upward from the rear brace 25 at an angle of about forty five degrees where it is fixably joined, at its upper end, with a longitudinal support piece 27, FIG. 4.

Figure 2:
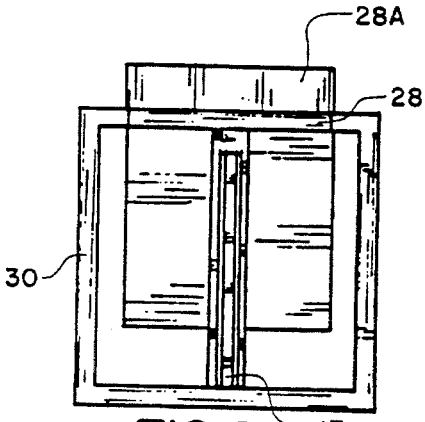
FIG. 2 is a front elevation view of the stretching bench of FIG. 1.
Figure 4:
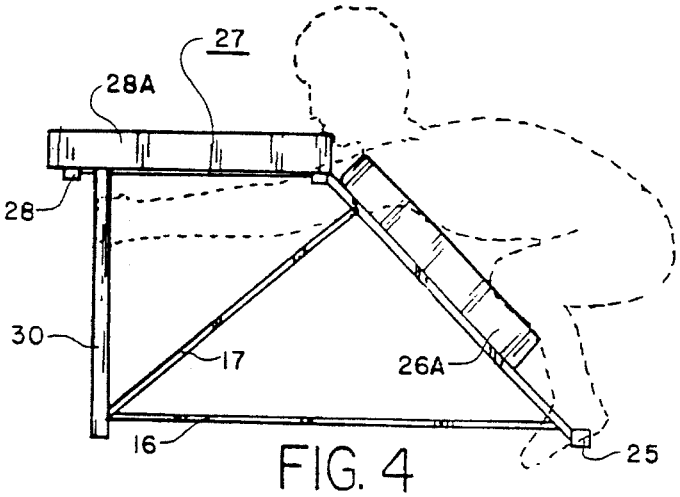
FIG. 4 is a side elevation view of the stretching bench of FIG. 1 in which the human form shown in phantom is illustrative of the environment of our invention.
Figure 3:
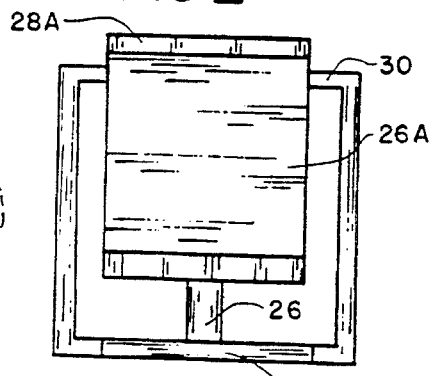
FIG. 3 is a rear elevation view of the stretching bench of FIG 1.

Front support 30 as best shown in FIGS. 1 and 2 is a square structure having a combined floor brace at the bottom, a parallel upper body rest board brace at the top and a pair of upstanding side rails. At about waist height for the user, the angled rear support 26 is fixedly joined at transition area 29 to the horizontal support 27 as shown in FIGS. 1 and 4.

Braces 16 and 17 are struts that are welded or otherwise rigidly fastened to the designated support pieces in order to add stability to the single rail supports 26, 27 and 30 which form the primary support structure as described. The upright side rails of support 30, as shown in FIG. 4, are useful for grasping by the user in certain stretching activities and as an arm brace as will be described hereinafter.

Each of the main support structures 26, 27 and 30 have located thereon a padded body rest support surface shown as two padded cushions 26A and 28A, respectively. In stretching on the bench 15 the user 19, shown in phantom lines, first leans his knees near the lower edge of inclined body rest 26A and then continues leaning forward until his upper thighs are resting on 26A and his waist is at the angled transition junction area 29, FIG. 1.

User 19 bends at the waist and by leaning further forward can rest his upper torso on the body board 28A while his lower torso is reclining along the incline surface 26A. Next the user 19 pulls himself forward toward the front portion of horizontal support surface 28A so that his feet are off the floor. Transverse bar 28 is located near the forward end of body support surface 28A and serves both for support and as a hand hold for inching forward on the bench.

In the position shown in FIG. 1, gravity can begin to work on the user's body. At this point the user's upper torso is essentially fully supported in a horizontal position on 28A and his feet will be dangling slightly away from the floor as shown in FIG. 1. While face down with arms hanging down toward the floor as shown in FIG. 1, gravity will stretch the vertebrae of the user as the lower torso tends to stretch down the incline 26A while the prone upper torso essentially holds the user on the bench's horizontal surface 28A.

It is important to understand that this stretching bench relies upon the pull of gravity upon the lower dangling ramped part of the user's body to relieve some of the tightness and tenseness in the muscles and vertebrae in the user's back. The prone user can be in a face down ("traction through relaxation"), face up ("back extension") or sideways posture ("lateral flexion") on the stretch bench. In any of these positions gravity pulls on the dangling part of the user's frame supported by the ramped body rest portion 26A.

The stretching activity in any of these positions, generally starts at a higher location on the bench and requires "inching down" movements in order to stretch individual vertebrae. As the user 19 inches down the uprights of forward support 30 may serve as an arm brace to keep the upper torso of user 19 on the horizontal portion 28A. Individual vertebrae are stretched with each "inching down" movement until finally the user's feet touch the floor.

In summary, therefore, the unique and novel configuration of our stretching bench promotes a reverse gravity affect on the user's spine and back. Our novel bench design, rather than directed toward anchoring certain parts of the user's body as is common for exercises, focuses instead on benefits attainable by stretching, relaxation and self mobilization.

Certain features of our novel bench and the benefits to the user attainable thereby will now be described. Additional benefits to the basic bench configuration of FIG. 1, are depicted by the improved bench configurations shown in FIGS. 5 through 8. Benches 15 in these embodiments include spaced floor supports and height adjustments 65 and 75 for both the front and rear of benches 15. A single main support frame is included which also houses a secondary longitudinal support frame parallel to and spaced from the horizontal portion of the primary support frame, Additionally these embodiments both include an adjustable arm brace and hand grip assembly 100 mounted for user-initiated selective movement along said second support frame.

Before climbing fully onto the bench proper for the bench embodiments of FIGS. 5 through 8, the user will have previously adjusted the height of the bench such that the user's waist line is at the crease of the bench where the ramped and horizontal portions meet. In FIG. 1 that crease portion was designated as 29. A neutral position for the arm brace is also set by the user to adjust for the user's arm length.

The grip bar 100 is set by the user to this neutral position when the user assumes a position on the bench similar to that shown in FIG. 4 except with the user's back straighter and essentially horizontal with the horizontal portion 28A. The user's chin is almost touching the pad at the crease and the user is stretched out such that the user sights down the horizontal position. This arm brace location will assure that the arm brace meets the back of the arms during "inching down" movements and prevents the user's upper body from moving, as the user's lower body stretches downward providing desired traction in the vertebrae and muscles.

Figure 5:
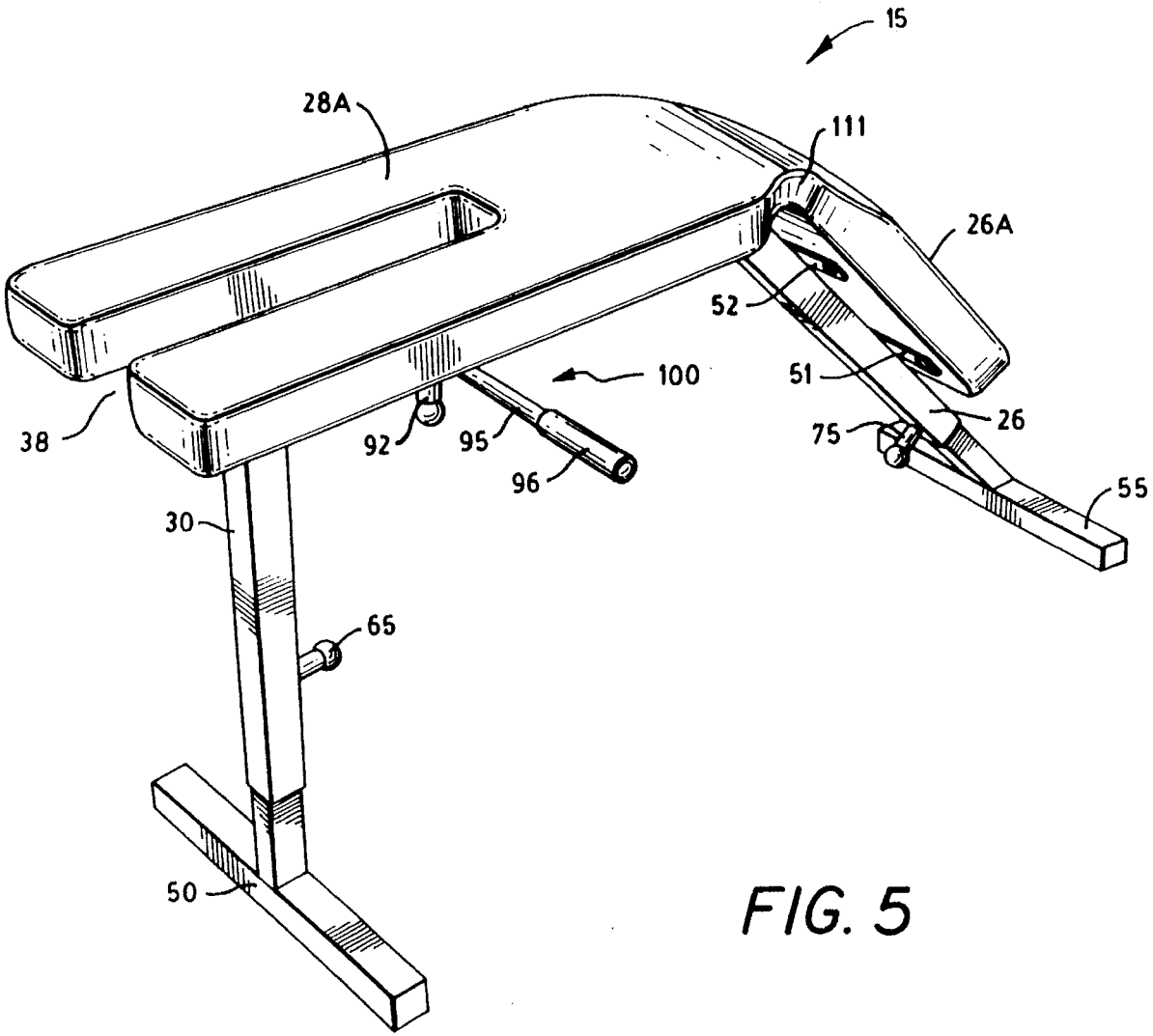
FIG. 5 is a top elevation view of another embodiment of our invention having bench having hour glass cut outs in a single-piece padded body board and an adjustable arm brace and hand grip assembly.

After making these initial adjustments the user's bench is individually tailored for the particular individual. The user repeats the mounting sequence described earlier for FIG. 1 for the stretch bench embodiments of FIGS. 5 through 8. When prone as shown in FIG. 1 a face cut out 38, FIG. 5, is provided for bench 15 as depicted in the embodiments of FIGS. 5 through 8. In these embodiments, the horizontal body rest surface 28A is elongated more than that shown for the bench configuration in FIGS. 1 through 4, and face relief cut out 38 allows the user to more fully rest his upper body and his head on surface 28A. When prone face down and feet dangling away from the floor and the lower torso resting on the ramp 26A a mild gravity-assisted traction is applied to the user. Through relaxation in a face down position with arms hanging in a relaxed manner toward the floor, the user's back pain tends to disappear. The user initially climbs high on the bench with his face in the cut out 38. If needed, the user has the flexibility to adjust the arm brace 100 while the user is on the bench so that the back of the user's arms are resting against the arm brace 100. The user will simply count the number of holes so that the neutral position is known, should the arm brace require movement to place the arm brace against the back of the arms. A reverse gravity affect takes place during inching down stretching and highly beneficial treatment of the back and shoulder blades is achieved.

Several different activities are significant in vertebrae alignment and stretching for user 19. FIG. 4 depicts a self-mobilization move that is done on any of the benches 15. Such an activity is performed after a few minutes of prone face down stretching action in which gravity has been acting on the user's lower body and arms.

In the self-mobilization move, the user, by grasping both opposed upright sides of the front support frame 30 (FIG. 1, or hand grip assembly 100, FIGS. 5 through 8) rocks or "throws back" with a single fluid movement somewhat like a wave on water, and assumes a squatting posture in which the knees of the user are still resting on the bench. The user ends in a cat like squatting move similar to that of FIG. 4 except with the back straight and horizontal. At the end of the "wave" the user will feel a slight tug. That fluid movement and tug in self-mobilization further enhances stretching of the user's back and alleviates back pain and back-related problems.

It is important to note that in the view of FIG. 4, the user is in essence looking down or "sighting" alone the horizontal surface 28A. Additionally, this sequence of first reverse gravity affect and then rocking back in a squat position is a vertebrae alignment method that is readily achieved by the stretch bench of this invention. It naturally and greatly improves the spinal condition and tends in a rather dramatic manner to relieve back pain.

In the embodiment of FIGS. 5 through 8, a pair of spaced apart inverted T-shaped floor supports 50 and 55, respectively, are telescoped into the main support rail portions 26 in the rear and a single upright section post 30 in the front of bench 15. Each of these inverted T-shaped and telescoped sections are manually adjustable by the use of a pair of spring loaded detent pins 65 and 75 which are selectively inserted into an appropriate hole from a series of holes in an opposing face of support units 50 and 55, respectively.

In the embodiment of FIGS. 5 through 8, the telescoping centers for the inverted T floor supports 50 and 55 are inserted into the primary single rail support structures 26 and 30, respectively. As was true for the structure of FIGS. 1 through 4, the rail support has three main pieces 26, 27 and 30 each welded or otherwise suitably joined together. A spaced series of cross braces 51 and 52 support the body rest pads and fasten them to the primary single rail support pieces.

Figure 8:
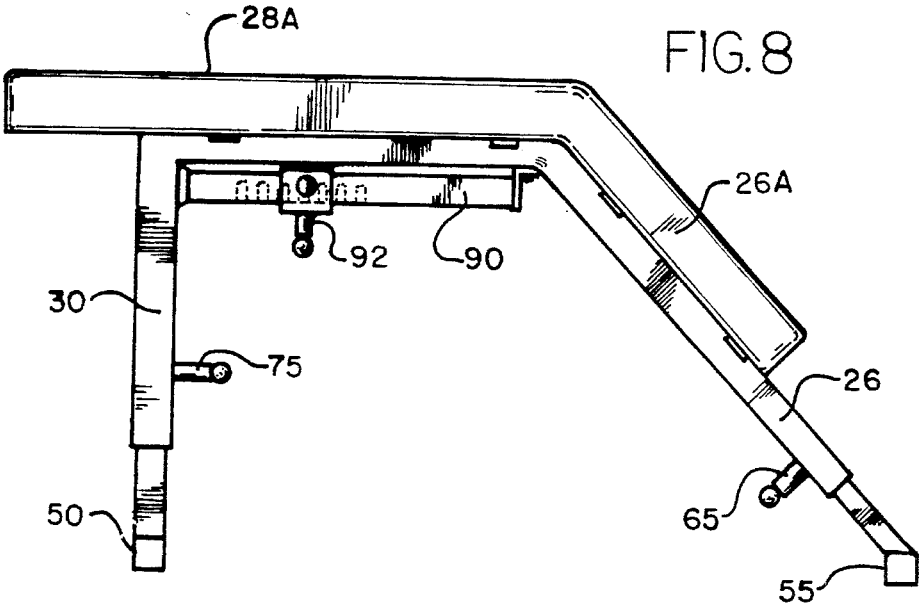
FIG. 8 is a side view of the stretching bench of FIG. 7 useful in explaining the on-bench adjustability feature of our invention.

The side view of FIG. 8 clearly show that an inclined primary support rail 26 is welded to horizontal rail 27 and also that the horizontal primary support 27 is additionally welded to a single downward depending upright 30 which is located at the front of stretch bench 15. At its lower end, floor brace 50 telescopes into the front upright 30, and at the rear of bench 15, incline support 26 telescopes over rear support 55.

Figure 6:
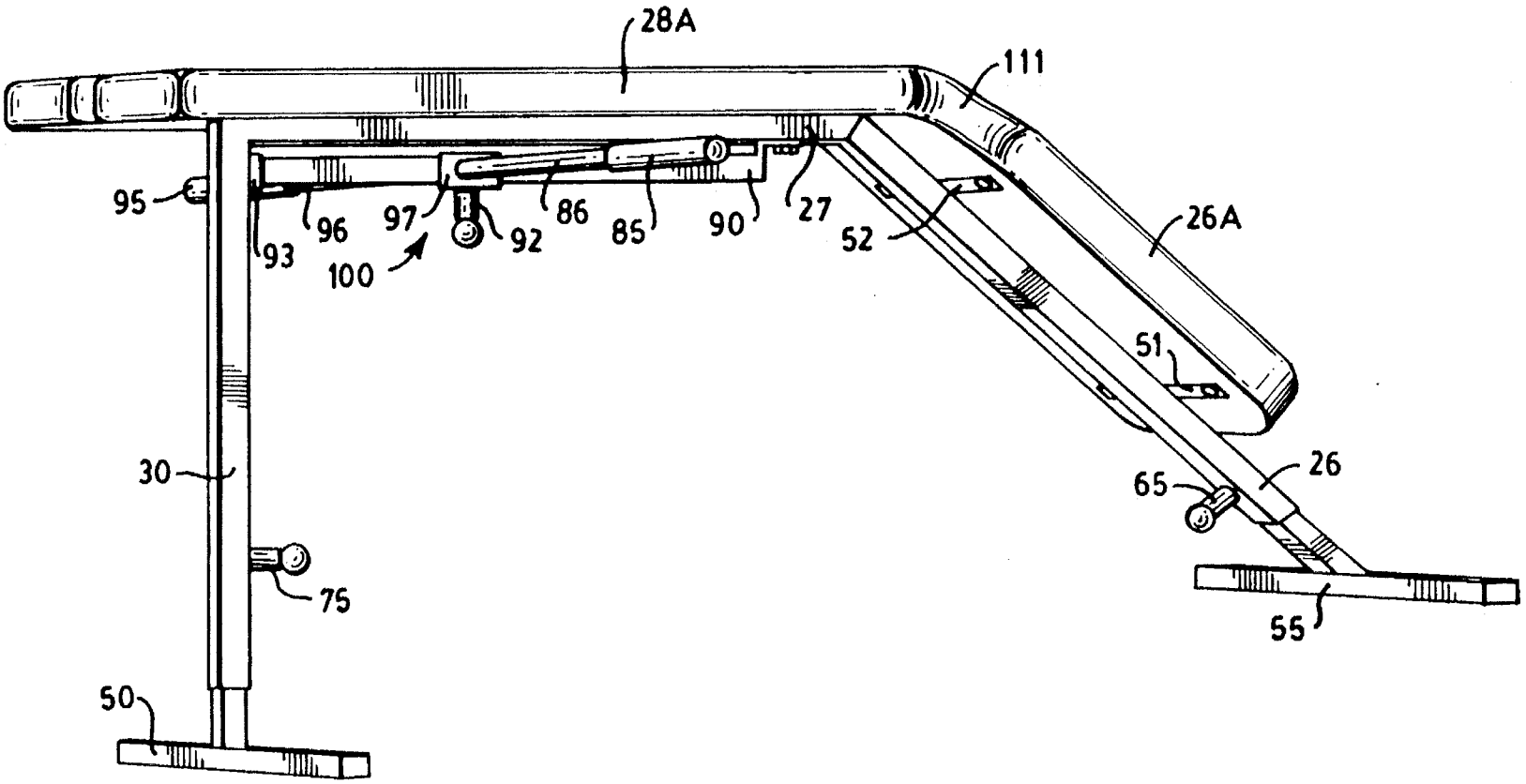
FIG. 6 is a lower perspective view of the embodiment of FIG. 5 which shows the adjustable arm brace of the invention slidable along a parallel brace located under the main support frame for the horizontal body rest portion of the bench.

A pair of front and rear adjustable spring loaded detents 65, 75 of any suitable type are inserted into the telescoping portions 26 and 30 so that the bench 15 can be adjusted both at the front and at the rear. In the embodiment of FIGS. 5 and 6 the telescoping nature of the single rail support provides both a manual front and rear adjustability feature which our experience has shown is valuable in customizing the stretching bench 15 for individual users. When used at home, for example, the adjustable detents 65 and 75 include a spring loaded pin that selectively engages any one of a series of inner openings on uprights 50 and 55 relative to single outer opening on supports 26 and 30 in line along and between the telescoped front and rear sections of these supports. By this common adjustment technique, the height for bench 15 may be selected to match the user's particular height. Once so adjusted and customized for that particular user, these spring loaded detents remain in a generally set hole location.

Such spring loaded pin/detent structures 65 and 75 are well known in bench and exercise equipment as shown and described, for example, in FIG. 6 of the aforesaid Kecala '967 patent. And no further description is believed necessary. Obviously other types of adjustability may be used provided that such units are readily user friendly.

In FIGS. 5 through 8 a manually adjustable arm brace and hand gripper assembly 100 is shown positioned below the horizontal tube 27 comprising the primary support frame for the horizontal portion 28A of a single-piece body rest board. Grip and bracing assembly 100 includes two transverse arm extensions 85, 95 securely affixed to a slidable collar 97. Slipped over the ends of 85, 95 are a pair of hand grips 86, 96.

Collar 97 includes a pin and detent unit 92 that is selectively adjustable by the user. The user while on the bench, may pull down on the spring loaded knob 180, FIG. 9, of detent unit 92 and release the current setting for collar 97. Once released collar 97 will manually slide as selected by the user back and forth on a separate cantilevered rail 90 that is also longitudinal with, and parallel to, the main horizontal support 27.

Rail 90, at the front end, is seated in an upstanding socket enclosure 93 that is securely welded or otherwise fastened to the inside face at the upper end of front upright 30. At its rearward end, rail 90 welded or otherwise fastened to an overlapping angle brace that is additionally bolted to the underside of horizontal support 27. Rail 90 is thus spaced from and parallel to longitudinal support 27. Rail 90 as connected is securely affixed to and becomes part of the bench support where it can serve as the adjustable setting for the arm and grip assembly 100.

Figure 9:
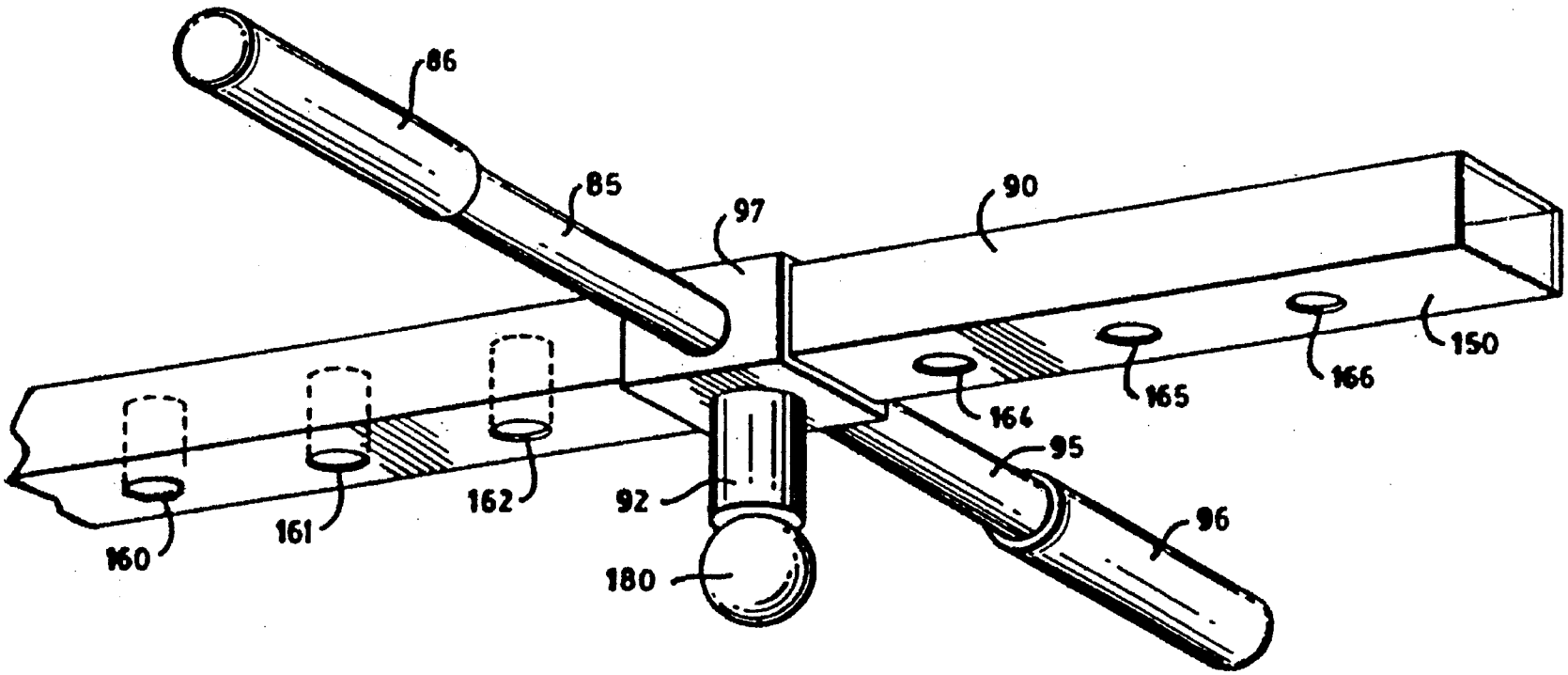
FIG. 9 is a partial perspective view of the adjustable arm brace and hand grip assembly for the benches of FIGS. 5 through 8.

Certain stretching activities require the arm brace 100 to be in a given one of the front locations from among a series of selected positions as shown in dashed form in rail 90 of FIG. 9. The particular setting for the arm brace 100 is first established at a neutral position for the particular user 19 as described earlier herein. In a neutral position, for the bench embodiments of FIGS. 5 through 8, the user assumes a squatting position similar to the position shown by user 19 in FIG. 4 except that for the FIG. 5 through 8 embodiments, the user holds the hand grips 86, 96.

Other related stretching activity for that particular user may require that arm brace 100 be moved back slightly to a more rearward hole on rail 90. In accordance with this invention, the position of hand rail 100 may be adjusted without interrupting a stretching activity. It is an important aspect of this invention that arm brace 100 provides on-the-bench adjustability. Additionally the embodiments of FIGS. 5 through 8 permit a user to brace an elbow against the arm (and elbow, in this case) brace and hold unto the front upright support 30 for a series of alternate arm and leg raises while face down in a prone position. If the left arm is locked at the elbow while holding on to the front upright 30, the right arm and left leg is raised and vice-a-versa.

Additionally the hand grips of the arm brace/grip assembly are used in a "cat back"stretching activity in which the users back is highly arched upward. During this arched "cat back" stretch the user's knees are on the ramp incline and the user's head is almost touching the bend in the body rest pad. For this stretch activity the location of the grip may require a tailored movement for a given individual as selectively set along the rail 90.

In FIG. 9 the hand grip and arm brace assembly 100 is shown in more detail. An underside surface 150 of rail 90 includes a series of equally spaced openings 160 through 166. Collar 97 may be slid from one opening to another as selected by the user. Such sliding requires ball 180 on detent unit 92 to be pulled downward in order to overcome an internal spring loading (not shown)in casing 175. Such pulling releases the detent portion of a pin from its present seat in an opening 163 (hidden from view in collar 97) and the collar may be moved to another opening as desired by the user.

Figure 7:
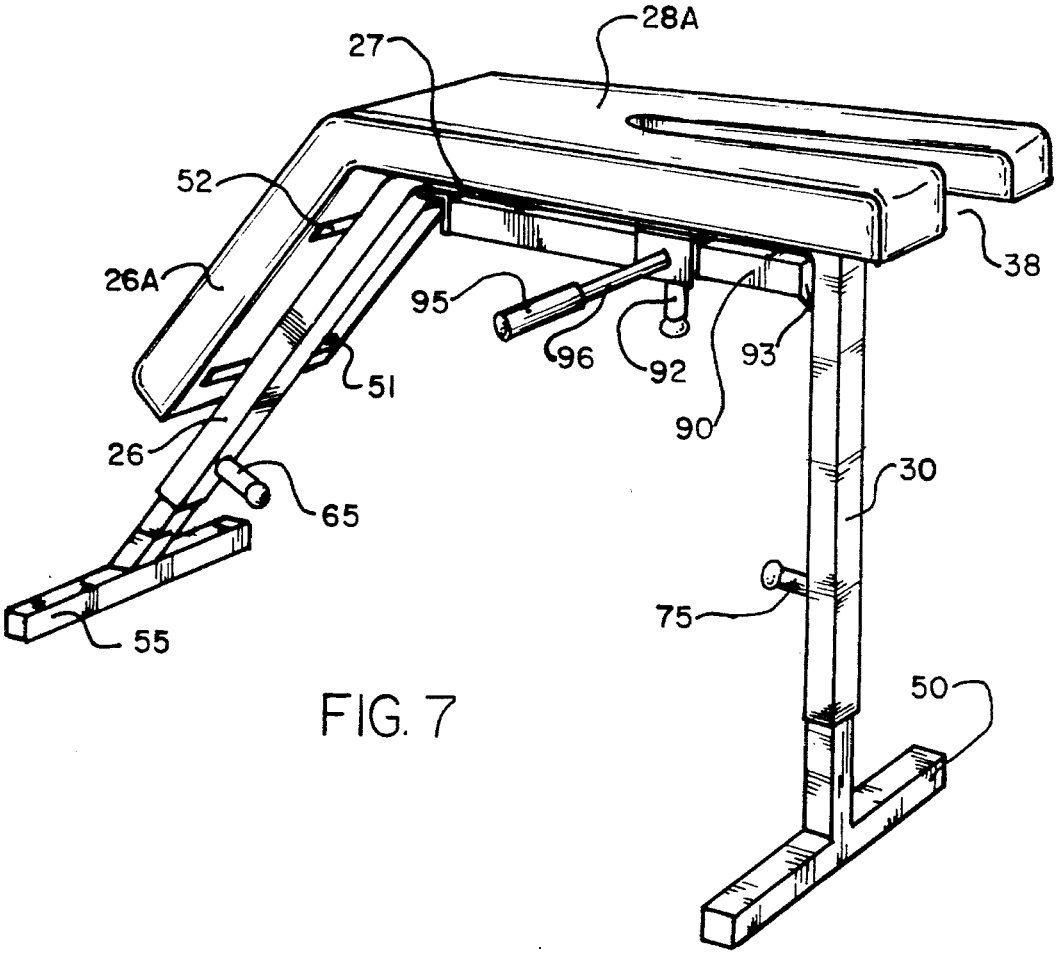
FIG. 7 is a perspective view of another embodiment of our stretch bench also having a single piece body rest portion.
Figure 10:
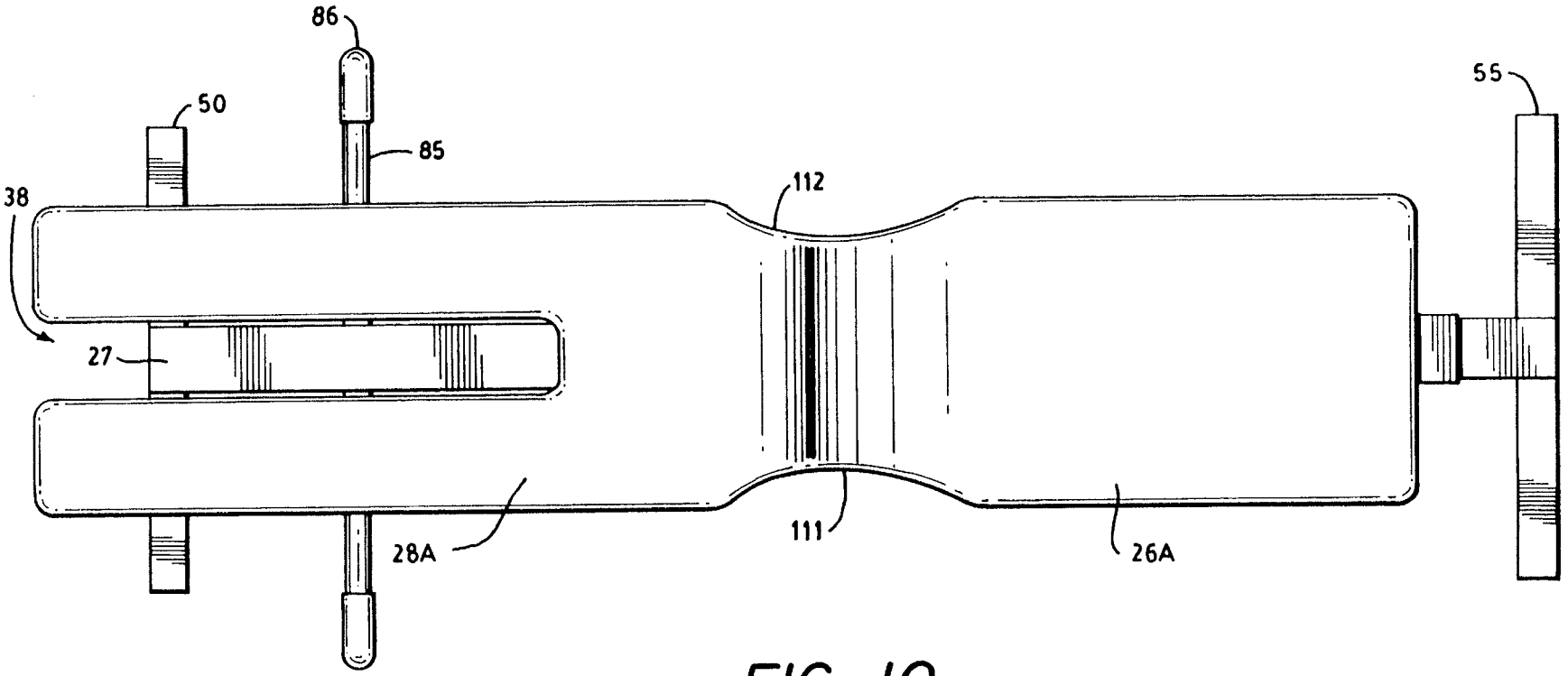
FIG. 10 is a top plan view of the single-piece body support pad with an hour glass shaped cut out for the bench of FIGS. 5 and 6.

FIG. 10 shows a top view of the single unit body rest board having both the horizontal and ramp portions 26A and 28A for the bench embodiments of FIGS. 7 and 8. As is more clearly shown in FIG. 10, a pair of cutouts 111 and 112 at the junction area allow ample space for the user's arms to move freely in certain of the stretching moves described earlier.

While various changes may be made in the detail construction, it shall be understood that such changes will be within the spirit and scope of the present invention as defined by the appended claims.

What is claimed is:

1. A combination self-mobilization and stretch bench about waist height for a user that positions his upper torso on a horizontal pad and allows his lower torso to be angled against an inclined support pad with the user's feet dangling away from the floor, which position allows the user to rely upon gravity action on the user's body in order to stretch the user's back for relief of back pain, said bench having a front and a rear base support and adapted for use on a level horizontal floor or other similar base surface, said bench comprising:

a pair of spaced apart floor surface base supports, with the front support being vertical for the front of said bench and the rear supped of said bench being at an incline of about forty five degrees to the vertical;

an inclined body support and knee receiving pad angled at about said forty-five degree angle for allowing the user, while his feet are on the floor, to first lean his knees against a knee receiving portion of said inclined body support pad and then lean his upper and lower body forward unto the bench:

a horizontal body support pad horizontal to the base surface for supporting the upper torso of a user who may recline in a prone position with the user's upper torso on said horizontal body support pad and his lower torso supported on said inclined body support pad of the bench with the user's feet dangling off the floor for a stretching activity:

a fixed rigid support frame held by said first and second floor supports and having horizontal and inclined frame sections respectively for supporting said horizontal and inclined body support pads in a fixed position on said rigid support frame;

a pair of bench height adjustment means, one each at the front and rear base supports, for adjusting the height of both of said body support pads of said bench relative to said base surface in order to allow a user to set the height of said horizontal body support pad at about waist height and the inclined support pad so that the user's knees touch the knee receiving portion of said inclined pad while the user's feet are on the floor; and one single transverse arm brace and hand grip means located toward the forward portion of said bench under said horizontal body support pad, with said arm brace and hand grip means being position adjustable by a user while the user is lying prone on the bench;

an arm brace portion of said transverse means allowing the user to rest a user's upper arms against the arm brace portion and thereby stabilize the position of the user's upper torso on said bench while the lower torso tends to slide down the inclined body support pad; and a hand grip portion of said transverse means allowing the user to grasp the hand grip portion and rock back away from said bench with the user's knees still resting against the inclined body support pad, with his feet on the floor and while holding said hand grip portion for a self-mobilization stretching activity.

2. A bench in accordance with claim 1 and further comprising:

a single adjustment means, user-operable while the user is on said bench, for user adjustment of the location of said arm brace and hand grip means in order to adjust the position of said arm brace and hand grip means for the individual user.

3. A bench in accordance with claim 2 wherein said inclined and horizontal rigid rail support frame sections are rigidly connected together as an integral non-adjustable piece at an obtuse angle of about 135 degrees for supporting said horizontal and inclined body support pads, and said support frame further comprises a second horizontal support rail located parallel to and under said horizontally support frame section;

means for slidably mounting said arm brace and hand grip means on said second horizontal support frame section; and a manually operable positioning means for adjusting the position of said arm brace and hand grip means in a back and forth direction along said second support frame section and beneath the underside of said horizontal body support pad by the user while the user is supported on said bench.

4. A bench in accordance with claim 3 wherein said manually operable positioning means for adjusting the position of said arm brace and hand grip means, further comprises:

a slidable collar holding a bar located transverse to and below said horizontal body support pad, which transverse bar serves both as said arm brace and as said hand grip means; and said slidable collar being selectively adjustable and lockable manually in an adjusted position along said second support frame section by the user.

5. A bench in accordance with claim 4 wherein said means for adjusting the location of said arm brace and hand grip means further comprises:

said slidable collar rides along said second support frame section and spring loaded detent means mounted on said slidable collar and capable of being moved and locked in position on said second support frame section by said user while the user is on said bench and said stretch activities are on-going.

6. A bench in accordance with claim 3 wherein said body support pad is divided into two separate sections and provides a body support which further comprises:

a first separate inclined padded body support pad anchored to said inclined angle rail support frame section with said first padded body support pad having its lower end starting near the floor and its upper end terminating short of an integral junction between said inclined and said horizontal support frame sections for said bench;

a second separate padded horizontal body support pad spaced away from the terminating portion of said first inclined body support pad and forming an arm receiving space between the two pads for receiving the users arms during the rocking back and squat move performed during the self-mobilization stretching activity.

7. A bench in accordance with claim 6 wherein said body support pad further comprises:

an arm receiving means in the form of a space between said first and second separate body support pads, which space tends to allow the user's arms to straddle the inclined frame support section and at the same time avoid contact with said body support pad when the user rocks back with the user's feet on the floor and his knees against the inclined support pad for said self-mobilization stretching activity.

8. A bench in accordance with claim 1 wherein said body support pad further comprises:

a single piece padded body support pad said horizontal and inclined body support pad with said single padded piece having about a forty-five degree bend therein at the junction of said incline angle and said horizontal angle.

9. A bench in accordance with claim 1 wherein said body support pad further comprises:

a pair of spaced-apart cut outs, one at each side of said pad at said bend, which cut outs tend to allow the user's arms to avoid contact with said body support pad when rocking back for said self-mobilization stretching activity.

10. A bench in accordance with claim 1 wherein said self-mobilization stretching activity requires:

the user to assume a squatting position with his back essentially horizontal relative to the base surface while holding himself on the bench's rear brace support and with arms extended and both hands grasping hand holds located on said stretch bench in the forward portion thereof; and said bench further comprises;

said arm brace and hand grip means being located in an upright portion of said rigid support frame which acts as a front bench support.

11. A bench in accordance with claim 1 wherein said self-mobilization stretching activity requires:

the user to assume a squatting position with his back essentially horizontal relative to the base surface while holding his feet on the bench's rear brace support and with arms extended forward; and said bench further comprises:

said arm brace and grip means being adapted to slide along a secondary horizontal rail, which secondary rail is rigidly connected to an upright portion of said rigid support frame which acts as a front bench support;

and the user has both hands grasping hand holds located on the ends of a transverse bar of said arm brace and hand grip means which has been slid to a position on said secondary rail that allows the user to reach the hand holds while his feet are on the support brace and his knees are on the inclined body support pad.

12. A bench in accordance with claim 1 wherein said front bench support comprises and upright portion of said rigid support frame, and said bench further comprises:

an upright rigid bar adjustably telescoped into an inverted T front brace support located at the front of said bench.

13. A bench in accordance with claim 1 wherein said inclined portion of said rigid support frame further comprises:

an angled rigid bar adjustably telescoped into an angled inverted T rear brace support located at the rear of said stretching bench.

14. A bench in accordance with claim 4 wherein said positioning adjustments for said arm brace and hand grip means are accomplished by spring loaded detent unit that locks into one of a series of openings between said collar which holds said detent and said second support frame section of said rigid support frame.

15. A stretch bench in accordance with claim 12 wherein said front and rear height adjustments are accomplished by a pair of spring loaded detent units, one each at the front and at the rear, which detent units each lock into one of a series of openings between said telescoped portion holding said detent and said inverted T shaped member respectively in the rear and front braces of said rigid support frame.

16. In a stretch bench for doing at least two separate stretching activities which allow a user to rely upon gravity action on the user's lower body in order to stretch the user's back and which also allows the user to lift away from said bench, said bench having a pair of hand grips and a pair of arm braces, front and a rear base supports which are adapted for use on a level floor-type surface, and said bench also having a pair of spaced apart floor surface base supports for the front and the rear of said stretching bench;

a height adjustable support frame held by said first and second floor supports for supporting at least one body support portion in a fixed position, with said height being at about waist height for the user;

the bench improvement allowing a user to perform at least two separate stretch activities, with said bench improvement comprising:

a combined inclined knee rest and lower torso body support pad connected to said support frame, with said combined pad angled at about forty-five degrees to the horizontal floor surface and extending upward from near the floor surface to about waist height as individually selected for a given user;

a horizontal body support pad also connected to said rigid support frame and having a longitudinal body support pad for supporting the torso of a user who may recline in a prone position with the user's upper torso on said horizontal body support portion and his lower torso supported on the inclined body support pad of the stretch bench with the user's feet dangling away from the floor's surface during a gravity stretching activity;

the angled position and nearness to the floor of said inclined pad, when said bench has been height-adjusted for an individual user, allowing the user's knees to be against the bench for mounting the bench and at the same time allowing the user to hold an arm brace and hand grip means with both hands while assuming a squat position with the user's back essentially horizontal in order to accomplish a self-mobilization stretching activity;

arm brace means located toward the forward portion of said stretch bench and under said horizontal body support pad as part of said bench support frame for stabilizing the user's upper torso on said horizontal body support portion of said bench for a mild traction reverse gravity action on the dangling lower torso of the user while the user's lower torso is resting on said incline with the user's feet away from the floor; and said arm brace means further having hand grip means combined with said arm brace means for allowing the user to rock back away from said bench with the user's feet on the floor and his knees still against the knee rest portion of said incline support pad while the user holds said hand grip means with both hands and assumes a squat position with the user's back essentially horizontal in order to accomplish a self-mobilization stretching activity.

* * * * *